United States Patent [19]

Jennis

[11] Patent Number: 4,833,363

[45] Date of Patent: May 23, 1989

[54] IGNITRON WITH ARC-CENTERING MAGNETIC FIELD

[75] Inventor: Barry Jennis, Colchester, England

[73] Assignee: English Electric Valve Company Limited, Chelmsford, England

[21] Appl. No.: 863,985

[22] Filed: May 16, 1986

[30] Foreign Application Priority Data

Jul. 16, 1985 [GB] United Kingdom ..... 8517890

[51] Int. Cl.[4] ..... H01J 1/50

[52] U.S. Cl. ..... 313/173; 313/171; 313/157; 313/160; 313/162; 313/232

[58] Field of Search ..... 315/344, 85; 313/170, 313/172, 160, 153, 161, 169, 232, 173

[56] References Cited

U.S. PATENT DOCUMENTS

| | | | |
|---|---|---|---|
| 456,598 | 7/1891 | Sautter | 313/153 |
| 795,689 | 7/1905 | Carbone | 313/153 |
| 954,434 | 4/1910 | Hewitt | 313/163 |
| 1,157,779 | 11/1915 | Hewitt | 313/163 |
| 1,498,536 | 6/1924 | Baruch | 313/153 |
| 1,714,407 | 5/1929 | Smith | 313/156 |
| 2,182,736 | 12/1939 | Penning | 313/161 |
| 2,210,816 | 8/1940 | Miles | 313/156 X |
| 2,473,826 | 6/1949 | Smith | 313/156 |
| 2,491,990 | 12/1949 | Longini | 315/344 X |
| 2,660,687 | 11/1953 | Coleman | 313/170 |
| 3,696,264 | 11/1972 | Clark, Jr. et al. | 315/344 |
| 3,893,768 | 7/1975 | Stephens | 313/163 |
| 4,100,446 | 7/1978 | Harada et al. | 313/161 |

FOREIGN PATENT DOCUMENTS

| | | | |
|---|---|---|---|
| 0098103 | 10/1924 | Fed. Rep. of Germany | 313/170 |
| 1146589 | 4/1963 | Fed. Rep. of Germany | 313/153 |
| 521763 | 5/1940 | United Kingdom . | |
| 1049785 | 11/1966 | United Kingdom . | |
| 1049786 | 11/1966 | United Kingdom . | |

OTHER PUBLICATIONS

McGraw-Hill Encyclopedia of Science and Technology, vol. 7, pp. 20-22, 1979.

Sears et al., *College Physics,* Adison-Wesley Publishing Co., Ed. 3, 1960.

Gilmour Jr. and Lockwood, "The Interruption of Vacuum Arcs at High DC Voltages", Apr. 1975, *IEEE Trans. on Electron Devices,* vol. 22, No. 4, pp. 173-180.

*Primary Examiner*—Palmer C. DeMeo
*Assistant Examiner*—Mark R. Powell
*Attorney, Agent, or Firm*—Spencer & Frank

[57] ABSTRACT

An ignitron device is provided in which a permanent annular magnet at least partly surrounds the region between the ignitron anode and the surface of a mercury pool connected to the cathode terminal, the magnet being effective to create an axial magnetic field in the aforementioned region which tends to constrain the discharge arc of the device towards the center of the pool and away from the envelope walls of the device.

12 Claims, 1 Drawing Sheet

IGNITRON WITH ARC-CENTERING MAGNETIC FIELD

BACKGROUND OF THE INVENTION

This invention relates to ignitron devices, that is to say a discharge device comprising, within a sealed chamber, a pool of liquid metal (usually mercury) connected to a cathode terminal and an anode electrode provided above the surface of said liquid metal.

Unlike a mercury arc rectifier which is normally operated with high levels of current, an ignitron device is normally required to operate with relatively low levels of current. Frequently such devices are used in so-called "crow-bar" operations in which case, following high current crow-bar discharges, the power supply follow-through current can last up to 50 ms and is usually at a level of several amps. At low currents (e.g. below 10 A) for long durations (e.g. above 5 ms) the mercury discharge arc in the ignitron device becomes unstable and moves in a random manner across the surface of the liquid metal pool. It is believed that collisions between this unstable arc and the envelope wall of the ignitron occur and cause a metallic arc to occur on the metal surface contaminating the ignitron and "de-ageing" of the device. "De-ageing" results in a reduction in hold-off voltage. It is also believed that stray magnetic non-axial fields from nearby power devices (transformers etc.) may aggravate this problem.

SUMMARY OF THE INVENTION

The present invention seeks to provide an improved ignitron device in which the above difficulty is reduced.

According to this invention an ignitron device includes means for magnetically constraining the discharge arc of the device towards the centre of the liquid metal pool and away from the envelope walls thereof.

Preferably said magnetic means comprises a permanent annular magnet at least partly surrounding the region between the anode of said ignitron device and the surface of said liquid metal pool, said magnet being effective to create an axial magnetic field in the region between said anode and the surface of said liquid metal pool.

DESCRIPTION OF THE PREFERRED EMBODIMENT

Figure 1:
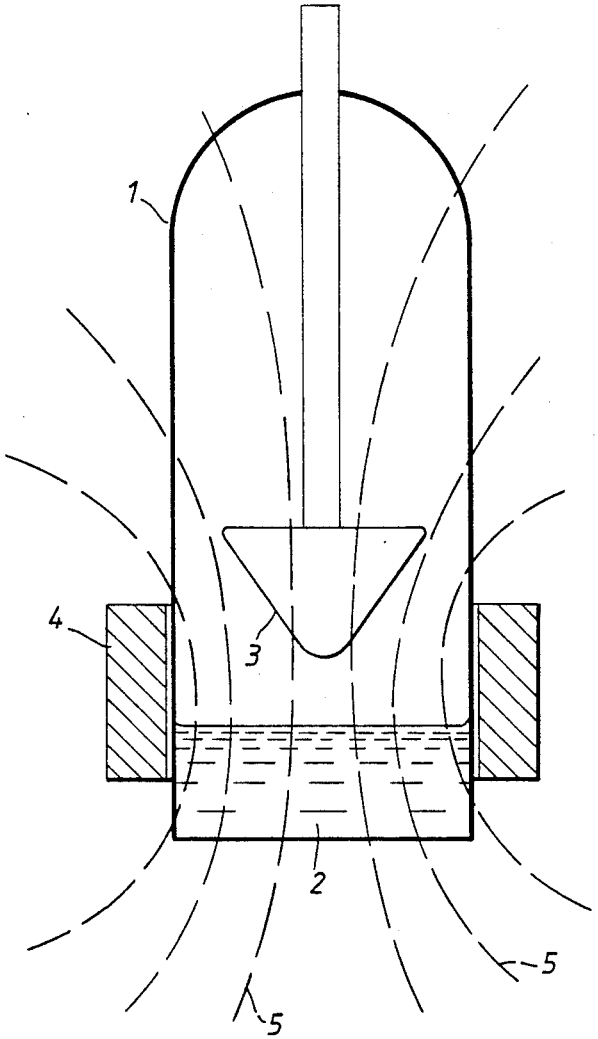
FIG. 1 is a section through one ignitron device in accordance with the present invention.

Referring to FIG. 1, the device consists of an evacuated envelope 1 in the base of which is a mercury pool 2. An anode 3, with a conically shaped end, is arranged coaxially above the mercury pool 2.

As so far described the arrangement is conventional. For the sake of clarity features such as water jackets, if water cooled, cathode connection to the mercury pool 2, ignitor electrode and ignitor connection, and so forth are omitted. For a more detailed description of the conventional features of an ignitron device reference may be made to the literature, for example to page 7–81 of the "Electronics Engineers Reference Book", Fourth Edition, published by the Butterworth Group.

In accordance with the invention, an annular permanent magnet 4 surrounds, in this case completely, the space between the anode 3 and the surface of the mercury pool 2. As will be seen the permanent magnet 4, in axial length, overlaps both the mercury pool 2 and the anode 3. Within the space between the anode 3 and the surface of the mercury pool 2 an axial magnetic field is induced, as represented by the dashed lines 5, which act to constrain the mercury discharge arc towards the axis of the device and away from the walls of the envelope 1 thus preventing collisions between the arc and the envelope wall at times when the arc is unstable.

Whether or not this explanation is correct it has been found that an ignitron device in accordance with the present invention tends to have a more predictable behaviour than a corresponding device without the aforementioned magnetic means. Because the mercury discharge arc tends to be more controlled, it may also be found that the low current performance is enhanced and reliability and life span improved.

Figure 2:
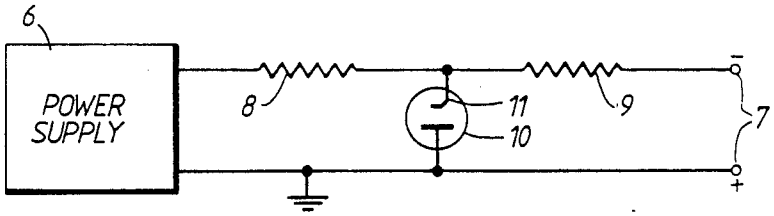
FIG. 2 is a circuit diagram of a typical power supply circuit using an ignitron device in accordance with the present invention in a "crow-bar" role.

Referring to FIG. 2, the circuit illustrated comprises a power supply 6 connected to supply load terminals 7. In the negative line from the power supply 6 to the load terminal 7 are connected two resistors 8, 9 in the series. An ignitron device 10 as described with reference to FIG. 1 is connected to operate in a "crow-bar" role across the output terminals of the power supply 6. The cathode electrode 11 of the device 10 is connected to a point between the resistors 8 and 9 whilst the anode is connected to the positive output line, which is grounded.

What is claimed is:

1. An ignitron device, comprising: an envelope having walls; a liquid metal pool in the envelope; an electrode spaced apart from the liquid metal pool; and means for creating an axial magnetic field in the region between the electrode and the surface of the liquid metal pool to magnetically constrain a discharge arc between the electrode and the liquid metal pool towards the centre of the liquid metal pool and away from the envelope walls.

2. An ignitron device as claimed in claim 1, wherein said electrode is an anode and wherein said means comprises a permanent annular magnet at least partly surrounding the region between the anode of said ignitron device and the surface of said liquid metal pool.

3. A circuit arrangement comprising: an ignitron device which includes an envelope having walls, a liquid metal pool in the envelope, an electrode spaced apart from the liquid metal pool, and means for creating an axial magnetic field in the region between the electrode and the surface of the liquid metal pool to magnetically constrain a discharge arc between the electrode and the liquid metal pool towards the centre of the liquid metal pool and away from the envelope walls.

4. A circuit arrangement as claimed in claim 3 and wherein said ignitron device is connected as a "crow-bar" device provided to operate with relatively low currents below ten amperes for relatively long durations above 5 milliseconds.

5. A circuit arrangement comprising: an ignitron device which includes an envelope having walls, a liquid metal pool in the envelope, an anode spaced apart from the liquid metal pool, and means for magnetically constraining a discharge arc between the anode and the liquid metal pool towards the centre of the liquid metal pool and away from the envelope walls, said means including a permanent annular magnet at least partially surrounding the region between the anode of said ignition device and the surface of said liquid metal pool, said magnet being effective to create an axial magnetic field in the region between said anode and the surface of said liquid metal pool.

6. A circuit arrangement as claimed in claim 5 and wherein said ignitron device is connected as a "crowbar" device provided to operate with relatively low currents below ten amperes for relatively long durations above 5 milliseconds.

7. A circuit arrangement for transferring electrical power to first and second terminals of a load, comprising:

a power supply having first and second terminals;

first and second impedance elements connected in series between the first terminal of the power supply and the first terminal of the load, the impedance elements being connected at an intermediate connection point;

a conductor connecting the second terminal of the power supply to the second terminal of the load; and an ignitron device, the ignitron device including an envelope having walls, a liquid metal pool in the envelope, the liquid metal pool being electrically connected to the intermediate connection point, an anode spaced apart from the liquid metal pool, the anode being electrically connected to the conductor, and means for magnetically constraining a discharge arc between the electrode and the liquid metal pool towards the centre of the liquid metal pool and away from the envelope walls, the means for magnetically constraining including means for creating a magnetic field which, at the centre of the surface of the liquid metal pool, is substantially perpendicular to the surface of the liquid metal pool.

8. A circuit arrangement as claimed in claim 7, wherein the means comprises an annular magnet at least partially surrounding the region between the anode and the surface of the liquid metal pool.

9. A circuit arrangement as claimed in claim 8, wherein the annular magnet is disposed outside the envelope walls.

10. A circuit arrangement as claimed in claim 9, wherein the anode has a lowermost region that is disposed above the surface of the liquid metal pool, wherein the annular magnet has a top end and a bottom end, and wherein the annular magnet is disposed so that the top end of the magnet is above the lowermost region of the anode and so that the bottom end of the magnet is below the surface of the liquid metal pool.

11. An ignitron device as claimed in claim 2, wherein the anode has a lowermost region that is disposed above the surface of the liquid metal pool, and wherein the annular magnet has a top end that is disposed above the lowermost region of the electrode and a bottom end that is disposed below the surface of the liquid metal pool.

12. A circuit arrangement as claimed in claim 5, wherein the anode has a lowermost region that is disposed above the surface of the liquid metal pool, and wherein the annular magnet has a top end that is disposed above the lowermost region of the electrode and a bottom end that is disposed below the surface of the liquid metal pool.

* * * * *